US006241336B1

(12) United States Patent
Muraki

(10) Patent No.: US 6,241,336 B1
(45) **Date of Patent: *Jun. 5, 2001**

(54) INK-JET PRINTER WITH PRINTING HEAD CAP

(75) Inventor: Motohito Muraki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/432,407

(22) Filed: Nov. 2, 1999

Related U.S. Application Data

(62) Division of application No. 08/810,106, filed on Feb. 25, 1997, now Pat. No. 6,007,180.

(30) Foreign Application Priority Data

Feb. 26, 1996 (JP) ..... 8-37761

(51) Int. Cl.[7] ..... B41J 2/165
(52) U.S. Cl. ..... 347/32; 347/29
(58) Field of Search ..... 347/29, 30, 31, 347/32, 33

(56) References Cited

U.S. PATENT DOCUMENTS

| | | | | |
|---|---|---|---|---|
| 4,728,970 | | 3/1988 | Terasawa | 347/30 |
| 5,343,228 | * | 8/1994 | Takada | 347/29 |
| 5,416,507 | * | 5/1995 | Otsuka | 347/32 |
| 5,619,232 | | 4/1997 | Maeno | 347/30 |
| 5,689,293 | | 11/1997 | Hirano | 347/33 |
| 5,757,395 | * | 5/1998 | Chew et al. | 347/24 |
| 5,757,397 | | 5/1998 | Hirano et al. | 347/30 |
| 6,007,180 | * | 12/1999 | Muraki | 347/32 |
| 6,019,452 | | 2/2000 | Hirano et al. | 347/30 |

FOREIGN PATENT DOCUMENTS

| | | | | |
|---|---|---|---|---|
| 0 630 754 A2 | * | 12/1994 | (EP) | B41J/2/165 |
| 630 754 A2 | | 12/1994 | (EP) | 347/29 |
| 720-912-A2 | | 7/1996 | (EP) . | |
| 61-118255 | | 6/1986 | (JP) . | |
| 2-187361 | | 7/1990 | (JP) . | |
| 2-194971 | | 8/1990 | (JP) . | |
| 7-148933 | | 6/1995 | (JP) . | |
| 4-104449 | | 9/1997 | (JP) . | |

* cited by examiner

*Primary Examiner*—N. Le
*Assistant Examiner*—Hai C. Pham
(74) *Attorney, Agent, or Firm*—Oliff & Berridge, PLC

(57) ABSTRACT

An ink-jet printer has a suction cap for avoiding discharge failure of an ink from a printing head. When the printing head comes to a restoring area, the suction cap is moved from a waiting position at which the suction cap is retracted from a passage for movement of the printing head to a protruding position at which the suction cap protrudes into the passage for movement of the printing head. The suction cap covers a nozzle surface of the printing head. A purge unit is driven to suck the ink remaining in the printing head through the suction cap. The suction cap is supported by a casing so that the suction cap is swingable when it is pressed against the printing head. The suction cap makes tight contact with the printing head in response to the nozzle surface of the printing head

19 Claims, 5 Drawing Sheets

INK-JET PRINTER WITH PRINTING HEAD CAP

This is a Division of application Ser. No. 08/810,106 filed Feb. 25, 1997, now U.S. Pat. No. 6,007,180. The entire disclosure of the prior application(s) is hereby incorporated by reference herein in its entirety.

FIELD OF THE INVENTION

The present invention relates to an ink-jet printer which has a purge unit for preventing ink-discharge failure or defective ink-discharge.

DESCRIPTION OF THE RELATED ART

An ink-jet printer is generally used for performing dot-matrix recording on a sheet of printing paper supplied and fed from a paper feeder by discharging ink droplets. However, the ink-jet printer sometimes undergo ink-discharge failure or defective ink-discharge. Such ink-discharge failure or defective ink-discharge is caused by various reasons including, for example, adhesion of dust to a nozzle tip for discharging ink droplets, immixture of bubbles in an ink supplied from an ink source, drying of the ink in a nozzle, and adhesion of paper dust from a recording medium to the nozzle during printing.

Accordingly, in order to provide a restoring unit for dissolving the ink-discharge failure or the defective ink-discharge so that a normal state is restored, it has been hitherto known to provide a purge unit having a suction cap which covers a nozzle surface of a printing head so that an ink is sucked from the printing head by the aid of a suction pump (see Japanese Patent Laid-Open No. 61-118255). Specifically, a cap slider for holding the suction cap is slidably engaged into a cap holder. The cap slider is allowed to make sliding movement with respect to the cap holder. Thus the suction cap is allowed to abut against the nozzle surface of the printing head.

However, in the case of the restoring unit or the purge unit as described above, the cap slider is slidably engaged into the cap holder with practically no play allowed to exist therebetween, in order to allow the suction cap to abut against the nozzle surface of the printing head with a high degree of positional accuracy. Therefore, if the cap surface of the suction cap has a low degree of parallelism with respect to the nozzle surface of the printing head, tight contact is poorly achieved when the suction cap is allowed to abut against the printing head, making it impossible to satisfactorily suck the ink from the nozzle.

An ink-jet printer is known, which is installed with a protective cap for covering a printing head in order to prevent a nozzle surface from drying when recording or printing is not performed. Such an ink-jet printer has had a problem in that the ink is dried if tight contact is poorly achieved between the protective cap and the printing head.

SUMMARY OF THE INVENTION

An object of the present invention is to provide an ink-jet printer which makes it possible to allow a suction cap to make tight contact with a nozzle surface of a printing head when the suction cap is pressed against the printing head regardless of an inclination of a surface of the suction cap with respect to the nozzle surface of the printing head.

Another object of the present invention is to provide an ink-jet printer which makes it possible to allow a protective cap to make tight contact with a nozzle surface of a printing head when the protective cap is pressed against the printing head regardless of an inclination of a surface of the protective cap with respect to the nozzle surface of the printing head.

According to a first aspect of the present invention, there is provided an ink-jet printer comprising:

- a printing head having a nozzle discharging ink droplets and printing an image on a printing medium at a printing area with the ink droplets;
- a carriage holding the printing head, which is reciprocatively movable along a surface of a sheet subjected to printing; and
- a cap unit comprising a cap covering the printing head, a cap-moving mechanism moving the cap frontward or rearward with respect to the printing head, and a swinging mechanism swinging a cap surface in response to an inclination of a printing head surface so that the cap surface makes tight contact with the printing head surface when the cap is pressed against the printing head surface.

The ink-jet printer of the present invention has the swinging mechanism swinging the cap surface of the cap unit in response to the inclination of the printing head surface. Therefore, the condition of tight contact between the cap and the printing head is remarkably improved when the cap covers the nozzle surface of the printing head after the cap is moved by the cap-moving mechanism from a waiting position at which the cap is retracted from a passage for movement of the printing head to a protruding position at which the cap protrudes into the passage for movement of the printing head.

The ink-jet printer of the present invention may further comprise a purge unit connected to the cap, for sucking the ink remaining in the nozzle of the printing head through the cap. The purge unit can suck the ink in the printing head through the cap while the cap makes tight contact with the printing head to cover the nozzle surface. In a preferred embodiment, the swinging mechanism may comprise a cap holder supporting the cap at the front end of the cap holder, a casing accommodating the cap holder with a play allowed to exist between the cap holder and the casing, and a resilient member connected to the cap holder so that the cap holder is urged toward the printing head. The cap holder is urged toward the printing head by the aid of the resilient member, and the casing accommodates the cap holder with the play allowed to exist between the cap holder and the casing. Accordingly, when the cap holder is non-uniformly pressed against the printing head, the front surface of the cap holder can swing depending on the inclination of the surface of the printing head so as to make tight contact with the surface of the printing head.

The cap holder may have an engaging projection at its front end and a fastening section avoiding disengagement from the casing at its back end respectively, and the casing may have a regulating projection disengageably engaging the engaging projection of the cap holder to regulate a relative positional relationship between the cap holder and the casing. By adopting such a structure, the cap holder is integrated with the casing by the aid of the urging force exerted by the resilient member when the cap is not pressed against the printing head. Accordingly, the cap held by the cap holder can be positioned with respect to the nozzle surface of the printing head with high positional accuracy when the casing makes sliding movement with respect to a frame member and the cap abuts against the nozzle surface.

The cap-moving mechanism may comprise an eccentric cam and an eccentric cam-engaging section connected to the casing. In this embodiment, the casing accommodating the cap is movable frontward or rearward with respect to the printing head in accordance with rotation of the eccentric cam.

The cap of the cap unit to be used in the ink-jet printer of the present invention may be a protective cap covering the nozzle of the printing head to avoid evaporation of the ink. Because the protective cap can swing in response to an inclination of the surface of the printing head, the printing head can be reliably covered to avoid evaporation of the ink. In a preferred embodiment, the swinging mechanism may comprise a holding frame supporting the protective cap at the front end of the holding frame, a movable housing accommodating the holding frame with a play allowed to exist between the holding frame and the movable housing, and a resilient member connected to the holding frame so that the holding frame is urged toward the printing head. The holding frame is urged toward the printing head by the aid of the resilient member, and the movable housing accommodates the holding frame with the play allowed to exist between the holding frame and the movable housing. Accordingly, when the protective cap is non-uniformly pressed against the printing head, the front surface of the protective cap can swing to make tight contact with the surface of the printing head.

The holding frame may have an engaging projection at its front end and a fastening section avoiding disengagement from the movable housing at its back end respectively, and the movable housing may have a regulating projection disengageably engaging the engaging projection of the holding frame to regulate a relative positional relationship between the holding frame and the movable housing. By adopting a structure, the holding frame is integrated with the movable housing by the aid of the urging force exerted by the resilient member when the protective cap is not pressed against the printing head. Accordingly, the protective cap can be positioned with respect to the nozzle surface of printing head with high positional accuracy when the movable housing moves toward the printing head and the protective cap abuts against the nozzle surface.

In case of the cap being the protective cap covering the nozzle, the cap-moving mechanism may comprise a guide mechanism guiding the cap movable in a direction of movement of the carriage and frontward or rearward with respect to the printing head. The guide mechanism may comprise a guide rod extending in a direction of movement of the carriage, a movable housing accommodating the cap and rotatably and slidably supported by the guide rod, and an inclined guide surface which is formed to gradually expand toward the movable housing and to extend along the guide rod and which is engaged with a portion of the movable housing. The expansion of the inclined guide surface toward the movable housing may increase as going away from the printing area in the direction of movement of the carriage.

The movable housing may have an engaging section engaging the carriage. When the carriage engages with the movable housing through the engaging section and moves, the movable housing is rotated toward the printing head while being slidably moved away from the printing area along the guide rod by virtue of guidance of the inclined guide surface, whereby the protective cap can move to a position for covering the nozzle of the printing head.

According to a second aspect of the present invention, there is provided an ink-jet printer comprising:

a printing head having a nozzle discharging ink droplets;

a carriage holding the printing head, which is reciprocatively movable along a surface of a sheet subjected to printing;

a driving unit driving the carriage;

a purge unit comprising a suction cap unit including a suction cap covering the printing head, a cap holder supporting the suction cap at its front end, a resilient member connected to the cap holder so that the cap holder is urged toward the printing head, and a casing accommodating the cap holder with a play allowed to exist between the cap holder and the casing, the cap holder having an engaging projection at its front end and a fastening section avoiding disengagement from the casing at its back end respectively, and the casing comprising a regulating projection disengageably engaging the engaging projection of the cap holder to regulate a relative positional relationship between the cap holder and the casing;

a suction pump, connected to the suction cap, sucking the ink remaining in the nozzle of the printing head through the cap; and a guide member engaging the casing to move the cap frontward or rearward with respect to the printing head.

The ink-jet printer of the present invention comprises the purge unit constructed as described above. Accordingly, it is possible to suck the ink remaining in the nozzle of the printing head while the suction cap makes tight contact with the printing head. The ink-jet printer may further comprise a protective cap unit having a cap capable of making tight contact with the printing head as described above, and a wiping unit wiping a nozzle surface of the printing head. The guide member may be an eccentric cam.

DETAILED DESCRIPTION OF PREFERRED EMBODIMENT

An embodiment of the present invention will be explained below with reference to the drawings.

Figure 1:
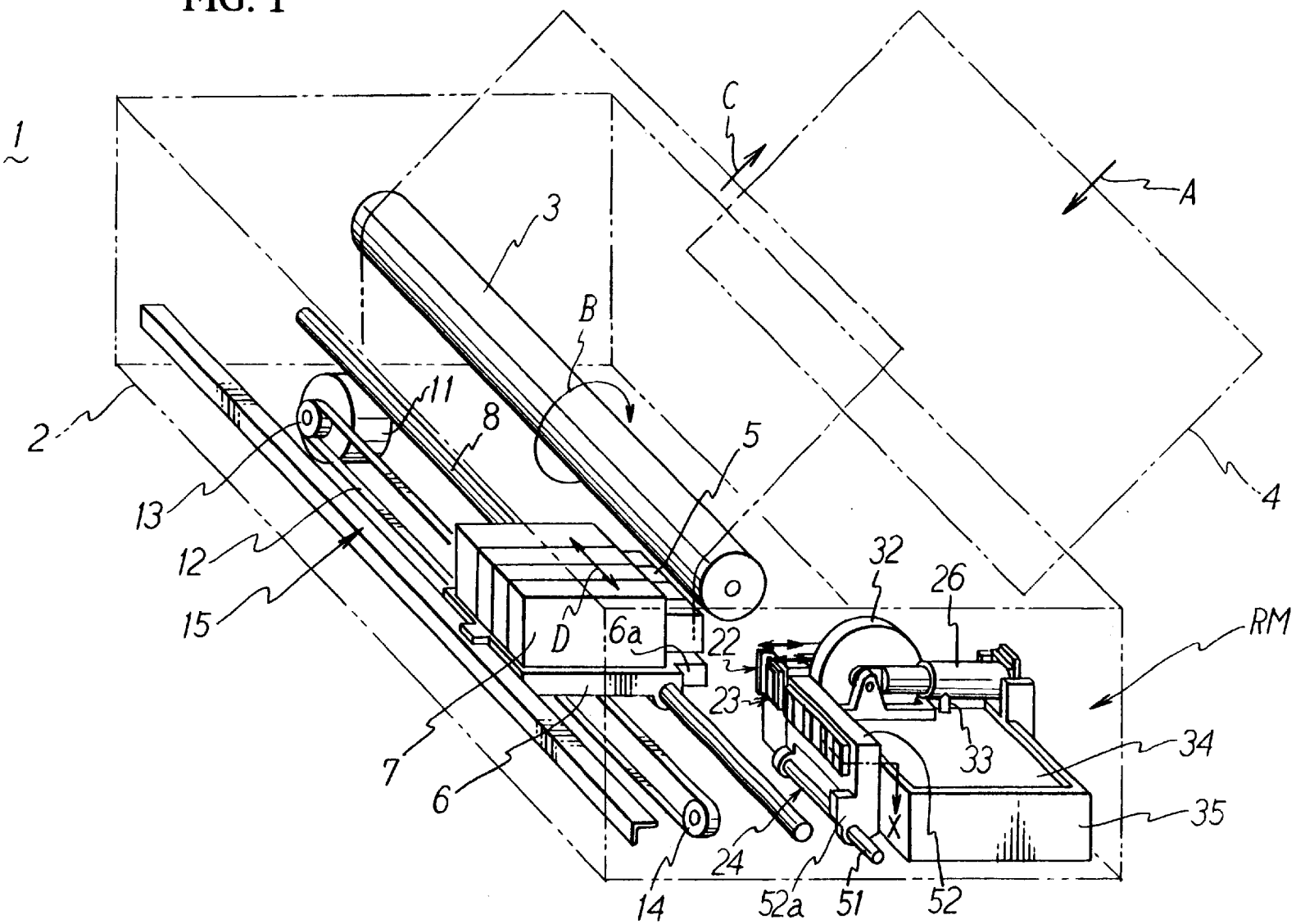
FIG. 1 shows a schematic perspective view illustrating an entire system of an ink-jet printer according to the present invention.

FIG. 1 shows a schematic perspective view of an illustrative ink-jet printer according to the present invention. The ink-jet printer 1 principally comprises printing heads 5 for the ink-jet printing, a carriage 6 for placing the printing heads 5 thereon, a carriage-moving mechanism for reciprocatively moving the carriage 6 in parallel to a surface of a sheet of printing paper 4, a platen roller 3 for feeding the printing paper 4, a restoring unit RM for restoring discharge failure of the printing heads 5, and a printer frame 2 for accommodating the foregoing. The platen roller 3 is a cylindrical roller rotatably supported on the printer frame 2 by the aid of a rotation shaft(not shown) extending in a longitudinal direction of the printer frame 2, i.e., extending laterally when the printer 1 is viewed from a position in front thereof. The printing paper 4 is supplied from a paper supply cassette or from a manual paper supply section, and the printing paper 4 is fed by the platen roller 3 while being confronted with the printing heads 5. The platen roller 3 constructs a part of a paper feeder.

The printing paper 4 is supplied in a direction indicated by an arrow A from an unillustrated paper supply port formed at the back of the printer frame 2. The printing paper 4 is fed in a direction indicated by an arrow B in accordance with rotation of the platen roller 3. The printing paper 4 is discharged in a direction indicated by an arrow C through an unillustrated paper discharge port.

The carriage 6 is provided in front of the platen roller 3 so that the carriage 6 is movable in directions indicated by an arrow D along an axis of the platen roller 3. The carriage 6 detachably carries the printing heads 5 as well as ink cartridges 7 for storing inks (of four colors in this embodiment) to be supplied to the printing heads 5 respectively. The carriage 6 is slidably inserted into a carriage shaft 8 provided in parallel to the axis of the platen roller 3. Thus the printing heads 5 carried on the carriage 6 are reciprocatively movable in a sliding manner along the axis of the platen roller 3.

The carriage-moving mechanism for reciprocatively moving the carriage 6 is constructed so that the carriage 6 is driven by a carriage-driving motor 11 by the aid of a belt-driving mechanism 15 having a belt 12 and pulleys 13, 14. A step motor or a DC motor is preferably used as the carriage-driving motor 11.

A restoring area is formed on the right of a printing area which is formed on the platen roller 3 described above. The restoring area is arranged with the restoring unit RM for restoring discharge failure or defective discharge of the printing head 5. The restoring unit RM is provided because of the following reason. Namely, the printing head 5 based on the ink-jet system suffers defective discharge due to several causes including, for example, occurrence of bubbles at the inside during the use, and adhesion of ink droplets onto a discharge surface. Accordingly, the restoring unit RM is provided in order to restore the defective discharge or the discharge failure to a favorable discharge condition.

Figure 2:
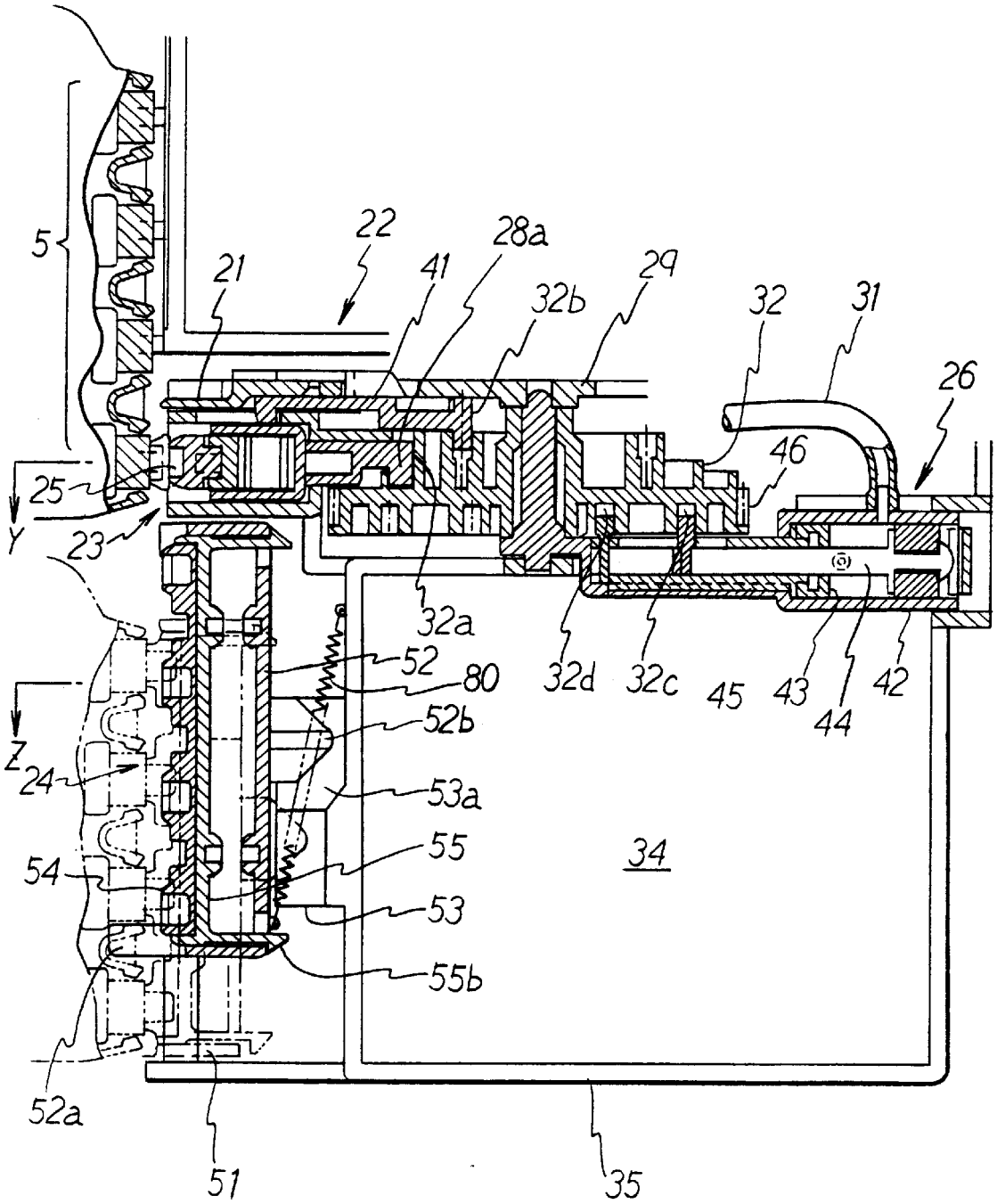
FIG. 2 shows a schematic cross-sectional view illustrating a cross section of a restoring unit, taken along a direction X shown in FIG. 1.
Figure 3:
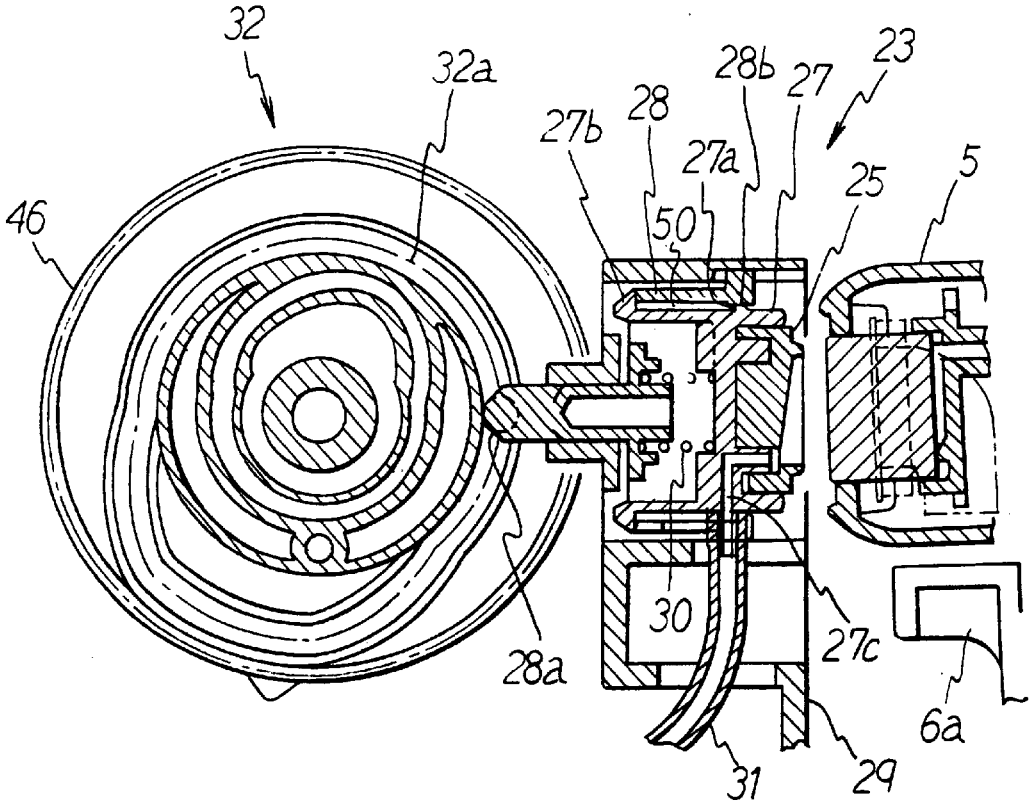
FIG. 3 shows a cross-sectional view illustrating a cross section of a purge unit, taken along a direction Y shown in FIG. 2, depicting a relationship between the purge unit and a cam member.
Figure 4:
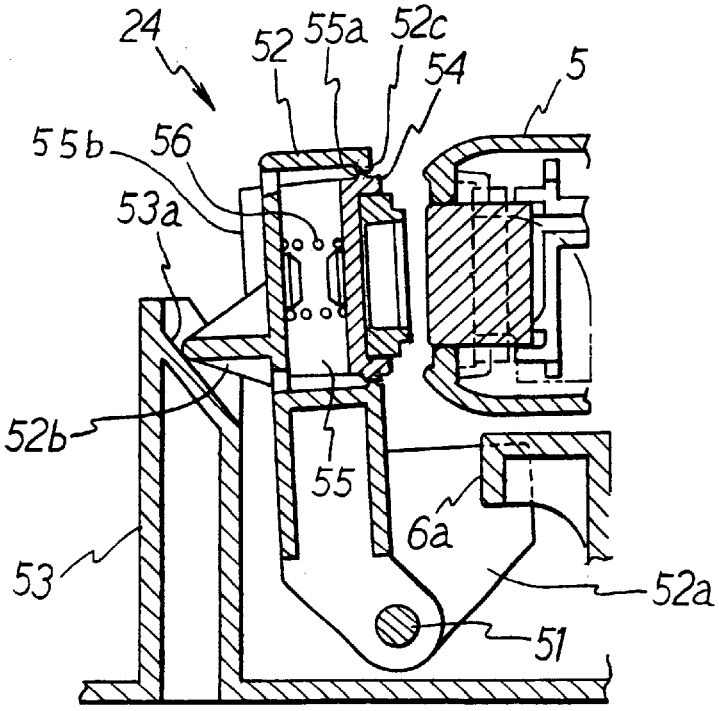
FIG. 4 shows a schematic cross-sectional view illustrating a cross section of a protective cap unit, taken along a direction Z shown in FIG. 2 when the protective cap unit is positioned at a position shown by a solid line in FIG. 2.

As shown in FIGS. 2 to 4 in detail, the restoring unit RM comprises a wiping unit 22 having a wiping member 21 for wiping the nozzle surface of the printing head 5, a purge unit 23 for sucking the ink remaining in the printing head 5, and a protective cap unit 24 for covering the nozzle surfaces of the printing heads 5 when printing is not performed so that evaporation of the ink is avoided by preventing the nozzle surfaces from drying.

The structure of the purge unit 23 will be explained by using FIG. 2 which shows a cross-sectional view illustrating a cross section of the restoring unit RM, taken along the direction X shown in FIG. 1, and by using FIG. 3 which shows a cross-sectional view illustrating a cross section of the purge unit 23, taken along the direction Y shown in FIG. 2. The purge unit 23 is movable between a protruding position at which the purge unit 23 protrudes into a passage for movement of the printing head 5 and a waiting position at which the purge unit 23 is retracted from the passage for movement of the printing head 5. Moreover, the purge unit 23 has a suction pump and a cap unit having a suction cap 25 for covering the printing head 5. The purge unit 23 generates a negative pressure by the aid of the suction pump 26 at the protruding position when the printing head 5 is covered with the suction cap 25, so that the remaining ink in the printing head 5 is sucked to restore a favorable discharge condition. The cap unit comprises the suction cap 25, a cap holder 27 for supporting the suction cap 25 at the front end of the cap holder 27, a movable casing 28 for swingably supporting the cap holder 27, and a frame member 29 for supporting the movable casing 28. The frame member 29 is provided with a guide groove 29*a* which makes it possible to slidably support the movable casing 28.

A spring member 30 is interposed between the cap holder 27 and the movable casing 28. The cap holder 27 is integrated with the movable casing 28 by the aide of the spring force exerted by the spring member 30 in an ordinary state in which no load is applied to the cap holder 27.

The cap holder 27 has an engaging projection 27*a* formed at its front end, and a fastening section 27*b* formed at its back end for avoiding disengagement from the movable casing 28. The cap holder 27 is movably (swingably) supported by the movable casing 28 with a play allowed to exist therebetween. A suction passage 27*c* is formed through the cap holder 27. The suction passage 27*c* is connected to one end of a suction tube 31 which penetrates through the movable casing 28 and extends to the suction pump 26.

The movable casing 28 has, at its back end, an engaging section 28*a* for engaging a cam section 32*a* of a cam member 32. The operation of the purge unit 23 is controlled by the cam section 32*a*.

A regulating projection 28*b*, which disengageably makes engagement with the engaging projection 27*a* of the cap holder 27 to regulate a positional relationship between the cap holder 27 and the movable casing 28, is formed at a front end of the movable casing 28. Owing to the engaging relationship therebetween and because of the fact that the cap holder 27 is movably supported by the movable casing 28 with a play allowed to exist therebetween, the cap holder 27 is movable swingable so as to be rotatable vertically as viewed in FIG. 3 with respect to the movable casing 28. If the suction cap 25 does not appropriately meet the nozzle surface of the printing head 5 under a poor contact condition, the cap holder 27 is rotated vertically to appropriately meet the nozzle surface. Thus correction is made so that the tight contact condition is improved.

As shown in FIGS. 2 and 3, the suction pump 26 is connected to the suction cap 25 through the suction tube 31. The suction pump 26 is connected to one end of a discharge tube 33 (shown in FIG. 1). The other end of the discharge tube 33 is connected to a waste ink tank 35 in which an absorbing material 34 is accommodated. Therefore, the remaining ink in the nozzle of the printing head 5, which is sucked through the suction tube 31 by the aid of the suction pump 26, is discharged to the waste ink tank 35 through the discharge tube 33. The ink is absorbed by the absorbing material 34 in the waste ink tank 35.

Frontward and rearward movement of the wiping member 22 of the wiping unit 22, frontward and rearward movement of the suction cap 25, and driving operation of the suction pump 26 are controlled by rotating the rotatably supported cam member 32.

Namely, as shown in FIG. 2, a wiper holder 41 for holding the wiping member 21 is engaged, at its back end, with a first cam groove 32*b* of the cam member 32. The movable casing 28 for supporting the suction cap 25 is engaged, at its back end, with a second cam groove 32*a*. Driving shafts 44, 45 of a pair of pistons 42, 43 of the suction pump 26 are engaged, at their back ends, with third and fourth cam grooves 32*c*, 32*d* respectively. Thus the foregoing members are subjected to control respectively. Such control makes it possible to perform a series of restoring operations. The wiper holder 41 is slidably supported by the frame member 29 together with the cap holder 27.

As shown in FIG. 3, the cam member 32 is integrally formed with a gear 46 which is selectively meshed with a driving gear that is always rotated and driven by a driving means such as a driving motor for the paper feeder.

The waste ink tank 35 is arranged with a guide rod 51 so that the guide rod 51 is parallel to the direction of movement of the carriage 6. The protective cap unit 24 is slidably and rotatably supported by the guide rod 51.

As shown in FIG. 4 which is a cross-sectional view illustrating a cross section of the protective cap unit 24, as viewed in the direction Z shown in FIG. 2, the protective cap unit 24 comprises a movable housing 52. The movable housing 52 is formed with an engaging section 52*a* for disengageably engaging an objective engaging section 6*a* formed on the carriage 6. Thus when the engaging section 52*a* is engaged with the objective engaging section 6*a* of the carriage 6, the movable housing 52 (protective cap unit 24) is slidably moved along the guide rod 51 in accordance with movement of the carriage 6. Further, the movable housing 52 has a guide projection 52*b* which protrudes rearward approximately at the center of the back surface in the lateral direction. When the movable housing 52 is slidably moved along the guide rod 51, the movable housing 52 is rotated toward the printing heads 5 by using the guide rod 51 as a center of rotation in accordance with an engaging relationship between the guide projection 52*b* of the movable housing 52 and an inclined guide surface 53*a* of a guide section 53 located at the back of the movable housing 52 and integrally formed with the waste ink tank 35.

The foregoing engaging relationship between the guide projection 52*b* and the inclined guide surface 53*a* will be explained below. With reference to FIG. 1, when the carriage 6 is moved in the right direction, the objective engaging section 6*a* of the carriage 6 pushes the engaging section 52*a* of the movable housing 52 to allow it to slide there together. In this process, the guide projection 52*b* of the movable housing 52 engages with the inclined guide surface 53*a* of the guide section 53, and it slides in the same direction as the movement of the carriage 6 on the inclined guide surface 53*a*. The inclined guide surface 53*a* is formed to gradually expand toward the movable housing 52 at its more rightward portions as viewed in FIG. 1. Accordingly, the guide projection 52*b* gradually approaches the printing head 5 in accordance with the sliding movement. Thus the movable housing 52, which is connected to the guide projection 52*b*, is rotated to approach the printing head 5.

The movable housing 52 is rotated by using the guide rod 51 as the axis of rotation as described above. Thus the protective cap unit 24 is movable between a protruding position at which the protective cap unit 24 protrudes into the passage for movement of the printing heads 5 and a waiting position at which the protective cap unit 24 is retracted from the passage for movement of the printing heads 5. The protective cap unit 24 has protective caps 54 for covering the nozzle surfaces of the printing heads 5. The protective caps 54 are movably (swingably) supported on the protective cap unit 24. Specifically, holding frames 55 are supported by the movable housing 52 rotatably in vertical directions as viewed in FIG. 4, with plays allowed to exist therebetween. Spring members 56 are interposed between the holding frames 55 and the movable housing 52. The holding frame 55 has an engaging projection 55*a* at its front end, and a fastening section 55*b* for avoiding disengagement from the movable housing 52 at its back end. The movable housing 52 has regulating projections 52*c* for disengageably engaging the engaging projections 55*a* of the holding frames 55 to regulate positional relationships between the holding frames 55 and the movable housing 52.

The movable housing 52 is integrated with the holding frames 55 by the aid of the spring force exerted by the spring members 56 in an ordinary state in which no excessive load is applied to the protective caps 54 from the printing heads 5. Thus the positional accuracy of the protective caps 54 is ensured with respect to the nozzle surfaces of the printing heads 5. When the protective cap 54 abuts against the nozzle surface of the printing head 5, if the former is not appropriately fitted to the latter without making tight contact therebetween, the holding frame 55 is displaced against the spring force exerted by the spring member 56 as described later on. Thus the relative positional relationship between the holding frame 55 and the movable housing 52 is altered so that the protective cap 54 contacts with the nozzle surface more tightly.

As shown in FIG. 2, a spring 80 is stretched between the back surface of the movable housing 52 and the waste ink tank 35. The spring 80 always pulls the movable housing 52 leftward as viewed in FIG. 1 (upward as viewed in FIG. 2). Therefore, the operation, in which the objective engaging section 6*a* pushes the engaging section 52*a* of the movable housing 52 rightward as viewed in FIG. 1 (downward as viewed in FIG. 2) to make sliding movement, is performed against the pulling force exerted by the spring 80. When the carriage 6 returns leftward as viewed in FIG. 1 (upward as viewed in FIG. 2), the movable housing 52 returns from a position depicted by two-dot dashed lines to a position depicted by solid lines in FIG. 2 by the aid of the pulling force exerted by the spring 80.

Next, the operation of the purge unit 23 with the suction cap connected thereto will be explained with reference to FIGS. 5 and 6.

The carriage 6 is driven by the carriage-driving motor 11 controlled by a control unit (not shown) of the ink-jet printer 1. Accordingly, one specified nozzle for a specified color selected from the nozzles of the printing heads 5, for which the restoring operation is instructed to be performed, is moved by the carriage 6 to a position at which the specified nozzle confronts with the suction cap 25.

Figure 5:
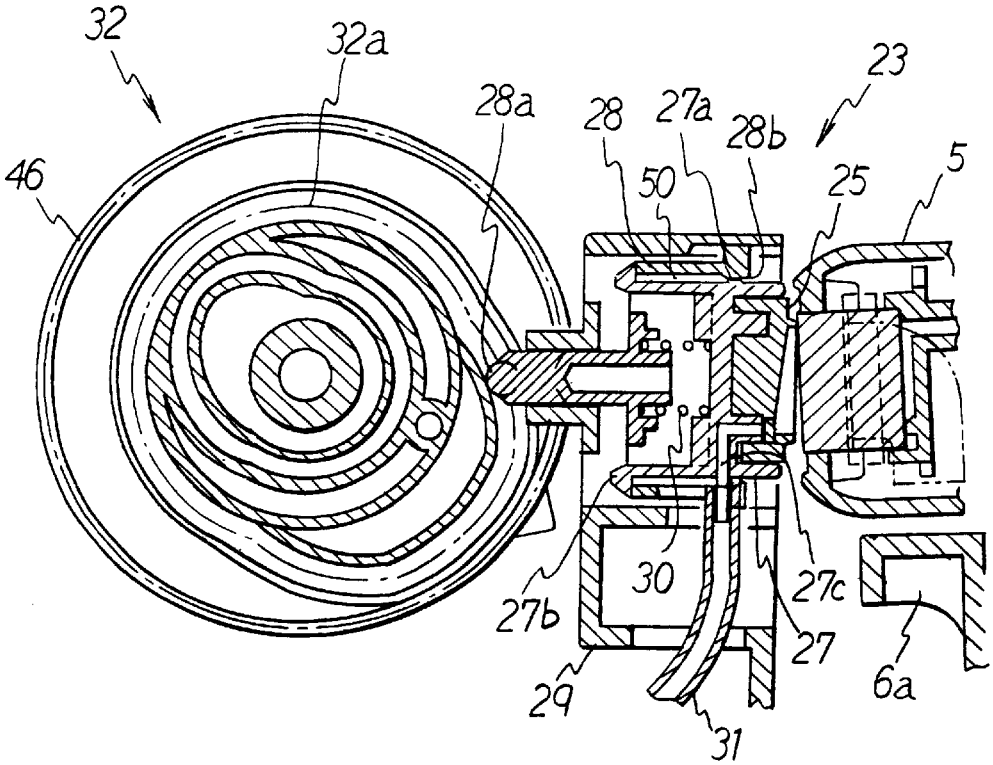
FIG. 5 shows a cross-sectional view illustrating a cross section of the purge unit, taken along the direction Y shown in FIG. 2, explaining operation of the purge unit.

Next, as shown in FIG. 5, the engaging section 28*a* of the movable casing 28 is pushed toward the printing head 5 in accordance with rotation of the cam member. In this process, the movable casing 28 is moved in a sliding manner in the frame member 29 toward the printing head 5 by the aid of the guide section 29*a* of the frame member 29. During the sliding movement of the movable casing 28, the cap holder 27 is urged toward the printing head 5 by the spring 30 interposed between the cap holder 27 and the movable casing 28. However, the cap holder 27 is not disengaged from the movable casing 28 owing to the presence of the fastening section 27*b* of the cap holder 27. The movable casing 28 is formed to have its inner circumference which is slightly larger than an outer circumference of the cap holder 27. Accordingly, a play is formed between the movable casing 28 and the cap holder 27. When the suction cap 25 does not contact with the printing head 5, the regulating projection 28*b* of the movable casing 28 is engaged with the engaging projection 27*a* of the cap holder 27 to regulate the positional relationship between the both. Based on the positional relationship between the cap holder 27 and the movable casing 28 thus regulated, the suction cap 25 is accurately positioned with respect to the printing head 5 when the suction cap 25 begins to contact with the printing head 5. Accordingly, the suction cap 25 more reliably contacts with the printing head 5 under a tight contact condition in accordance with swinging movement of the cap holder 27.

Figure 6:
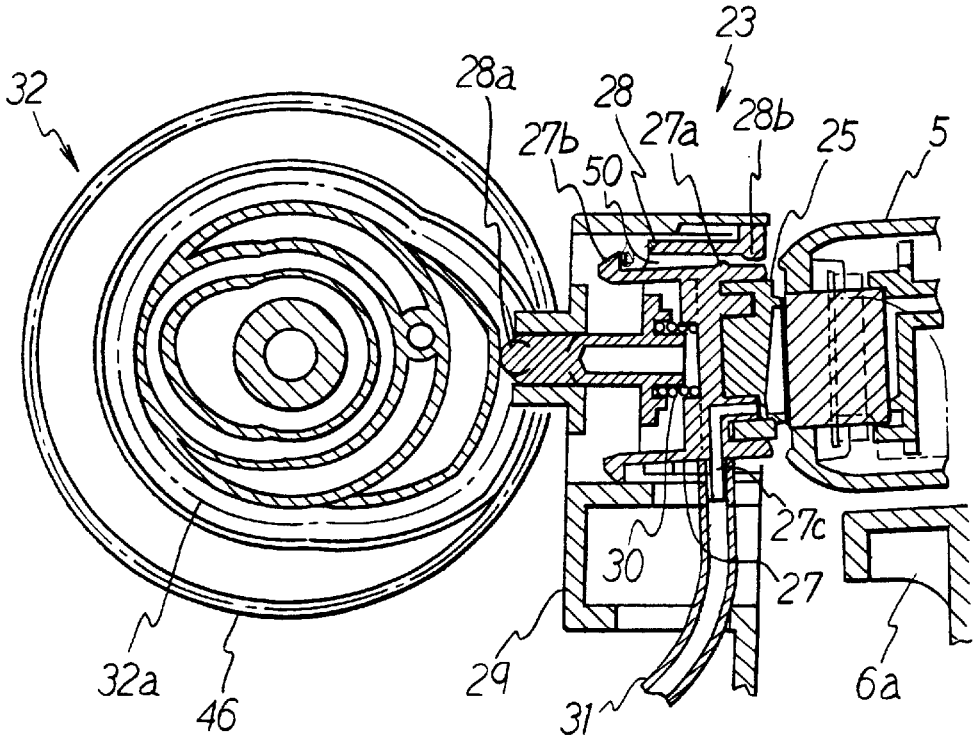
FIG. 6 shows a cross-sectional view illustrating a cross section of the purge unit, taken along the direction Y shown in FIG. 2, explaining operation of the purge unit.

As shown in FIG. 6, when the movable casing 28 is pushed toward the printing head 5 to its outermost position in accordance with further rotation of the eccentric cam 32, the cap 26 and the cap holder 27, which receive the reaction force from the printing head 5, are moved toward the cam 32 against the resilient force exerted by the spring 30. In this process, as shown in FIG. 6, if the surface of the printing head 5 is not parallel to the front surface of the cap 25, an upper portion of the surface of the printing head 5 is pressed by the printing head 5 more strongly than a lower portion of the surface. As a result, the front surface of the cap 25 is inclined toward cam 32 owing to the presence of the play 50. Accordingly, the front surface of the cap 25 swings, i.e., rotates vertically in response to the inclination of the printing head 5 against which the front surface of the cap 25 is pressed. Thus the front surface of the cap 25 can make tight contact with the surface of the printing head 5.

After the suction cap 25 makes tight contact with the printing head 5 as described above, the suction pump 26 is operated in accordance with rotation of the eccentric cam 32, and the ink remaining in the printing head 5 is sucked.

When no force is exerted on the suction cap 25 from the printing head 5, the cap holder 27 is integrated with the movable casing 28 by the aid of the spring force exerted by the spring member 30. Accordingly, the relative position between the cap holder 27 and the movable casing 28 is not changed.

After that, the suction cap 25 is moved rearward, while the wiping member 21 is moved frontward. The carriage 6 is allowed to move the nozzle in a direction to intersect the wiping unit 22. Thus the nozzle is wiped.

When the restoring operation is performed for the respective nozzles of the printing heads 5 corresponding to a plurality of colors, the operation is repeated for each of the nozzles corresponding to each of the colors in the same manner as described above.

Figure 7:
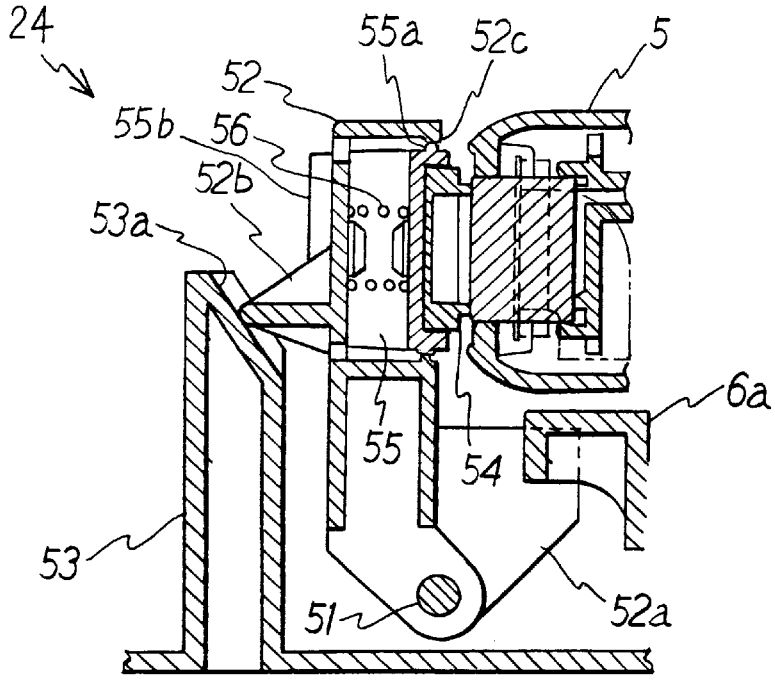
FIG. 7 shows a cross-sectional view illustrating a cross section of the protective cap unit, taken along the direction Z shown in FIG. 2, explaining operation of the protective cap unit when the protective cap unit is positioned at a middle position between a position shown by a solid line and a position shown by a two-dot chain line in FIG. 2.

The operation of the protective cap unit 24 will be explained with reference to FIGS. 7 and 8.

In the restoring area, the objective engaging section 6*a* of the carriage 6 is disengageably engaged with the engaging section 52*a* of the movable housing 52. While maintaining this engaging relationship, the movable housing 52 is moved in a sliding manner together with the carriage 6 along the guide rod 51. In this process, the protective cap unit 24 is rotated toward the printing heads 5 in accordance with the engaging relationship between the guide projection 52*b* and the inclined guide surface 53*a* as described above. Accordingly, the protective caps 54 are moved frontward toward the nozzle surfaces of the printing heads 5.

Figure 8:
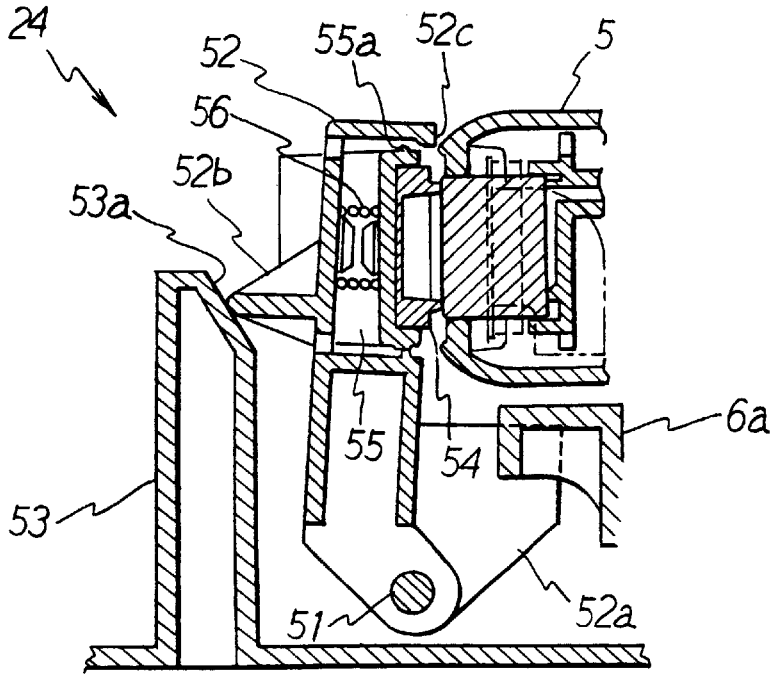
FIG. 8 shows a cross-sectional view illustrating a cross section of the protective cap unit, taken along the direction Z shown in FIG. 2, explaining operation of the protective cap unit when the protective cap unit is positioned at a position shown by a two-dot chain line in FIG. 2.

As shown in FIG. 8, when the protective cap 54 is pressed against the front surface of the printing head 5, the engaging projection 55*a* arranged on the upper side of the holding frame 55, which has been engaged with the engaging projection 52*c* arranged on the upper side of the movable housing 52, is disengaged from the engaging projection 52*c* arranged on the upper side of the movable housing 52. Accordingly, the surface of the protective cap 54 swings, i.e., rotates vertically with respect to the movable housing 52. Thus the relative positional relationship between the both is changed. Therefore, the protective cap 54 can make tight contact with the front surface of the printing head 5 to cover it, and the ink can be effectively prevented from evaporation through the nozzle of the printing head 5.

When no force is exerted on the protective caps 54 from the printing heads 5, the holding frames 55 are integrated with the movable housing 52 by the aid of the resilient force exerted by the spring members 56 and are positioned with respect to the movable housing by the aid of the engaging relationship between the engaging projection 52*c* of the movable housing 52 and the engaging projection 55*a* of the holding frame 55. As a result, the relative positional relationships between the both are not changed. Thus, when the protective cap 54 begins to contact with the printing head 5, the protective cap 54 can be positioned with respect to the printing head 5 with high positional accuracy.

In the embodiment described above, the cap holder 27 is rotatable only vertically with respect to the movable casing 28, and the holding frame 55 is rotatable only vertically with respect to the movable housing 52, in order to movably support the suction cap 25 and the protective cap 54. However, it is a matter of course that the cap holder 27 and the holding frame 55 may be rotatable not only vertically but also laterally (in the direction of the movement of the carriage 6).

In the embodiment described above, the cap unit connected to the purge unit 23 is arranged such that the cap holder 27 for supporting the suction cap at its front end is movably supported by the movable casing 28 with the play allowed to exist therebetween, and the movable casing 28 is slidably supported by the frame member 29. However, it is also possible to construct the cap unit such that a cap holder (holding frame) for supporting the suction cap at its front end is movably supported by a movable casing (movable housing) with a play allowed to exist therebetween, the movable casing being rotatably and slidably supported by a guide rod.

In the present invention, the cap of the cap unit is swingably supported. Accordingly, when the cap of the cap unit is moved from the waiting position to the protruding position to cover the nozzle surface of the printing head, the relative position of the cap is changed in response to the nozzle surface of the printing head. Thus the nozzle surface of the printing head can be covered with the cap under a satisfactorily tight contact condition.

Especially, the cap holder for supporting the cap at its front end is swingably supported by the movable casing with the play allowed to exist therebetween. Accordingly, when the movable casing is moved to make tight contact with the nozzle surface of the printing head, the cap holder swings so that the cap makes tight contact with the nozzle surface. Thus the nozzle surface can be covered with the cap under a satisfactorily tight contact condition. In an ordinary state, the cap holder is integrated with the movable casing by the aid of the spring force exerted by the spring member and is positioned with respect to the movable casing by the engaging relationship therebetween. Accordingly, it is possible to ensure the positional accuracy of the cap with respect to the nozzle surface of the printing head. Therefore, while the positional accuracy of the cap, which has been hitherto achieved, can be ensured, it is possible to improve the tight contact performance of the cap with respect to the nozzle surface of the printing head.

As for the protective cap unit, the holding frame for supporting the cap at its front end is movably supported by the movable housing with the play allowed to exist therebetween. Accordingly, when the movable housing is slidably moved on the guide rod to make tight contact with the nozzle surface of the printing head, the holding frame swings so that the cap makes tight contact with the nozzle surface of the printing head. Thus the nozzle surface can be covered under a satisfactorily tight condition. Therefore, for example, when printing is not performed, the ink in the printing head can be reliably prevented from evaporation by the aid of the protective cap. In an ordinary state, the holding frame is integrated with the movable housing by the aid of the spring force exerted by the spring member and is positioned with respect to the movable housing by the engaging relationship therebetween. Accordingly, it is possible to ensure the positional accuracy of the cap with respect to the nozzle surface of the printing head.

The present invention may be practiced or embodied in other various forms without departing from the spirit or essential characteristics thereof. It will be understood that the scope of the present invention is indicated by the appended claims, and all variations and modifications concerning, for example, the direction of movement of the cap holder and the holding frame, and the interchangeability in support system between the cap holder and the holding frame and between the movable casing and the movable housing, which come within the equivalent range of the claims, are embraced in the scope of the present invention.

What is claimed is:

1. An ink-jet printer comprising:

a printing head comprising at least one nozzle to print an image on a printing medium at a printing area by discharging ink droplets; and a cap unit comprising a cap to cover the at least one nozzle of the printing head, a cap-moving mechanism to reciprocate the cap in a direction toward and away from the printing head, and a cap surface swinging mechanism that accommodates the cap so as to freely move in at least one of a pitching direction and a yawing direction with respect to a surface of the at least one nozzle and adjusts a position of a cap surface of the cap in at least one of the pitching direction and the yawing direction in response to an inclination, with respect to the cap surface, of the surface of the at least one nozzle of the printing head until the cap surface makes a tight contact with the surface of the at least one nozzle of the printing head when the cap is pressed against the surface of the at least one nozzle of the printing head, the cap contacting the printing head at a predetermined position when the cap is pressed against the surface of the at least one nozzle of the printing head;

wherein the cap surface swinging mechanism comprises a cap holder supporting the cap at a front end of the cap holder, a casing accommodating the cap holder with a play existing between the cap holder and the casing, and a resilient member connected to the cap holder to urge the cap holder toward the printing head, the cap holder having an engaging projection, and the casing having a regulating projection disengageably engaging the engaging projection of the cap holder to regulate a positional relationship between the cap holder and the casing in a direction perpendicular to the direction toward and away from the printing head.

2. The ink-jet printer according to claim 1, further comprising a purge unit, connected to the cap, to suck ink remaining in the nozzle of the printing head through the cap.

3. The ink-jet printer according to claim 2, herein the cap holder is connected to the purge unit.

4. The ink-jet printer according to claim 1, wherein the cap-moving mechanism comprises an eccentric cam and an eccentric cam-engaging section connected to the casing, and the casing reciprocates toward and away from the printing head in accordance with rotation of the eccentric cam.

5. The ink-jet printer according to claim 1, wherein the cap unit further comprises a frame member accommodating the casing so as to slide toward and away from the printing head.

6. The ink-jet printer according to claim 1, wherein the cap of the cap unit is a protective cap covering the nozzle of the printing head to avoid evaporation of the ink.

7. The ink-jet printer according to claim 1, wherein the cap-moving mechanism comprises a guide mechanism to guide the cap in a direction of movement of the carriage, and in the direction toward and away from the printing head.

8. The ink-jet printer according to claim 7, wherein the guide mechanism comprises a guide rod extending in a direction of movement of the carriage, a movable housing accommodating the cap that rotates and slides on the guide rod, and an inclined guide surface which is formed to gradually expand toward the movable housing and to extend along the guide rod and which engages a portion of the movable housing.

9. The ink-jet printer according to claim 8, wherein the expansion of the inclined guide surface toward the movable housing increases as going away from the printing area in the direction of movement of the carriage.

10. The ink-jet printer according to claim 8, wherein the movable housing has an engaging section that engages the carriage.

11. The ink-jet printer according to claim 10, wherein when the carriage engages with the movable housing through the engaging section and moves, the movable housing is rotated toward the printing head while sliding away from the printing area along the guide rod by virtue of guidance of the inclined guide surface, whereby the cap moves to a position covering the nozzle of the printing head.

12. The ink-jet printer according to claim 7, wherein the guide mechanism comprises a guide rod extending in a direction of movement of the carriage, a movable housing that rotates and slides on the guide rod, and an inclined guide surface which is formed to gradually expand toward the movable housing and to extend along the guide rod and which engages a portion of the movable housing.

13. The ink-jet printer according to claim 1, further comprising a carriage holding the printing head, which reciprocatively moves along a surface of a sheet subjected to printing.

14. The ink-jet printer according to claim 1, wherein the cap holder further includes a fastening section to avoid disengagement from the casing at a back end of the cap holder.

15. The ink-jet printer according to claim 1, wherein the engaging projection of the cap holder is located at a front end of the cap holder.

16. The ink-jet printer according to claim 1, wherein the predetermined position is an upper end of the cap.

17. An ink-jet printer comprising:

a printing head comprising at least one nozzle for discharging ink droplets;

a carriage holding the printing head that moves along a surface of a sheet subjected to printing;

a driving unit to drive the carriage;

a purge unit comprising a suction cap unit including a suction cap to cover the at least one nozzle of the printing head, a cap holder supporting the suction cap at a front end of the cap holder, a resilient member connected to the cap holder to urge the cap holder toward the printing head, and a casing accommodating the cap holder with a play existing between the cap holder and the casing, the cap holder having an engaging projection at a front end of the cap holder and a fastening section to avoid disengagement from the casing at a back end of the cap holder respectively, and the casing having a regulating projection that disengageably engages the engaging projection of the cap holder to regulate a positional relationship between the cap holder and the casing;

a suction pump, connected to the suction cap, to suck ink remaining in the at least one nozzle of the printing head through the cap; and a guide member to engage the casing to move the cap toward and away from the printing head.

18. The ink-jet printer according to claim 17, further comprising a protective cap unit including a protective cap to cover the at least one nozzle of the printing head to avoid evaporation of the ink, a holding frame supporting the cap at a front end of the holding member, a resilient member connected to the holding frame to urge the holding frame toward the printing head, and a movable housing accommodating the holding frame with a play existing between the holding frame and the movable housing, wherein the holding frame has an engaging projection at a front end of the holding frame and a fastening section to avoid disengagement from the movable housing at a back end of the holding frame respectively, and the movable housing has a regulating projection disengageably engaging the engaging projection of the holding frame to regulate a positional relationship between the holding frame and the movable housing.

19. The ink-jet printer according to claim 18, further comprising a wiping unit to wipe a nozzle surface of the printing head.

* * * * *